US011866938B2

(12) United States Patent
Zullo

(10) Patent No.: US 11,866,938 B2
(45) Date of Patent: Jan. 9, 2024

(54) TRUSS

(71) Applicant: Claudio Zullo, Schenectady, NY (US)

(72) Inventor: Claudio Zullo, Schenectady, NY (US)

( * ) Notice: Subject to any disclaimer, the term of this patent is extended or adjusted under 35 U.S.C. 154(b) by 0 days.

(21) Appl. No.: 17/655,429

(22) Filed: Mar. 18, 2022

(65) Prior Publication Data

US 2023/0065838 A1 Mar. 2, 2023

Related U.S. Application Data

(60) Provisional application No. 63/238,445, filed on Aug. 30, 2021.

(51) Int. Cl.
*E04C 3/08* (2006.01)
*E04C 3/04* (2006.01)

(52) U.S. Cl.
CPC ..... *E04C 3/08* (2013.01); *E04C 2003/0413* (2013.01); *E04C 2003/0452* (2013.01); *E04C 2003/0491* (2013.01)

(58) Field of Classification Search
CPC ..... E04C 3/08; E04C 2003/0491; E04C 3/09; E04C 2003/0452; E04C 2003/0413; E04B 2001/2415; E04B 2001/2418; E04B 5/10
See application file for complete search history.

(56) References Cited

U.S. PATENT DOCUMENTS 1,813,373 A * 7/1931 Wooldridge ..... E04C 3/08 52/691
2,042,463 A * 6/1936 Henderson ..... E04C 3/08 52/645
2,152,189 A * 3/1939 Henderson ..... E04C 3/08 52/645
2,169,253 A * 8/1939 Kotrbaty ..... E04C 3/09 52/693
2,860,743 A * 11/1958 Cliff ..... E04C 3/08 52/693
3,152,671 A * 10/1964 Mallory, Jr. ..... E01D 6/00 52/693
3,541,749 A 11/1970 Troutner
3,826,057 A * 7/1974 Franklin ..... E04G 19/003 52/693
4,077,176 A * 3/1978 Bauer ..... E04C 3/292 52/693
4,253,210 A * 3/1981 Racicot ..... E04C 3/08 52/694
4,548,014 A * 10/1985 Knowles ..... E04C 3/292 52/693

(Continued)

FOREIGN PATENT DOCUMENTS

| | | | |
|---|---|---|---|
| AU | 2004202343 | B2 | 1/2005 |
| CA | 2481347 | C | 2/2011 |
| WO | 2005035893 | A1 | 4/2005 |

*Primary Examiner* — Theodore V Adamos
(74) *Attorney, Agent, or Firm* — Hoffman Warnick LLC

(57) ABSTRACT

A truss includes an upper angle assembly; the upper angle assembly including an upper gap positioned in the lower angle assembly; a lower angle assembly, the lower angle assembly including a lower gap positioned in the lower angle assembly; and at least one of: a web member; and a bridge web member. The at least one of the web member and the bridge web member is positioned within the gap of at least one of the upper angle assembly and the lower angle assembly.

7 Claims, 7 Drawing Sheets

(56) References Cited

U.S. PATENT DOCUMENTS

| | | | | |
|---|---|---|---|---|
| 4,748,786 | A * | 6/1988 | Hannah | E04C 3/08 52/694 |
| 5,806,265 | A | 9/1998 | Sluiter | |
| 6,634,153 | B1 * | 10/2003 | Peterson | E04C 3/08 52/695 |
| 6,993,880 | B2 | 2/2006 | Cameron et al. | |
| 7,634,888 | B2 | 12/2009 | Cloyd et al. | |
| 7,669,379 | B2 | 3/2010 | Schierding | |
| 8,141,318 | B2 | 3/2012 | Dunbar et al. | |
| 8,397,462 | B2 * | 3/2013 | Gulbrandsen | E04B 9/067 52/506.07 |
| 8,528,268 | B1 | 9/2013 | Reaves | |
| 8,763,345 | B2 | 7/2014 | Cloyd et al. | |
| 8,813,455 | B2 | 8/2014 | Merrifield | |
| 10,392,803 | B2 * | 8/2019 | Charest | E01D 6/00 |
| 10,400,453 | B2 | 9/2019 | Dietzen et al. | |
| 2003/0177732 | A1 * | 9/2003 | Wahlsteen | E04B 1/2403 52/655.1 |
| 2004/0111999 | A1 * | 6/2004 | Schipani | E04C 3/005 52/646 |
| 2005/0108978 | A1 * | 5/2005 | Strickland | E04C 3/07 52/633 |
| 2005/0144892 | A1 * | 7/2005 | Strickland | E04B 5/29 52/837 |
| 2010/0180531 | A1 * | 7/2010 | Arivett | E04C 3/09 52/643 |
| 2018/0347193 | A1 * | 12/2018 | Carr | E04C 3/08 |
| 2019/0338520 | A1 * | 11/2019 | Goh | E04C 3/04 |
| 2020/0115899 | A1 * | 4/2020 | Satchell | E04C 3/08 |

* cited by examiner

TRUSS

This non-provisional patent application claims priority from and the benefit of the filing date of earlier-filed Provisional Application 63/238,445 filed on Aug. 30, 2021 entitled TRUSS. The entire content of earlier-filed Provisional Application 63/238,445 filed on Aug. 30, 2021 is incorporated herein by reference for all purposes.

TECHNICAL FIELD

The disclosure relates generally to a truss having an upper and lower angle assemblies and a plurality of web members extending between the upper and lower angle assemblies.

BACKGROUND

Metal trusses may take on various shapes, but the most commonly encountered shape is defined by two upper chords joined at adjacent ends and each connected to a lower chord to create a generally triangular truss. Extending between the upper and lower chords may be a plurality of web members.

Metal trusses are structural trusses used for the fabrication of buildings in the construction industry. An application of structural trusses may be to define a desired roof line and support the roof by the building walls and interior structure. Trusses are typically fashioned from a series of joined vertical, horizontal, and angled members. Historically, some trusses have been fabricated from members joined by flat metal plates having a plurality of spiked projections therefrom for driving the plates into the wooden members and retaining the members in a joined relationship.

In recent years, metal trusses have gained favor in the construction industry. Metal trusses typically include metal U-shaped channels or C-shaped channels and tubular members with the members being joined by mechanical fasteners. The tubular members may be square, circular, or other tubular cross-sectional configurations.

A C-shaped channel member is prone to flexural torsional buckling for any given gauge or thickness of metal in comparison to a tubular or S-shaped web member. This is because the center of gravity and center of shear of a C-shaped channel member do not coincide. Consequently, a C-shaped channel member requires the use of relatively thicker metal or requires lateral bracing to provide additional strength. Additionally, a C-shaped channel member, in torsional buckling mode, precludes the use of continuous lateral bracing along only one edge of the web member. The use of heavier gage metal or significant lateral bracing increases the cost of manufacture and production of the metal truss.

The use of tubular pieces, either square or rectangular, as truss web members may result in greater strength for any given gauge of metal, however, the tubular piece must either be cold-rolled and then welded along a seam, or otherwise hot-rolled. Hot-rolled members are more expensive to manufacture than cold-rolled members. Similarly, the additional step of welding cold-rolled tubulars adds cost over cold-rolled tubulars without welding. Additionally, welded tubulars must be sealed after welding to prevent rusting, especially along the welded seam.

BRIEF DESCRIPTION

All aspects, examples and features mentioned below can be combined in any technically possible way.

An aspect of the embodiments sets forth a truss. The truss includes an upper angle assembly; the upper angle assembly including an upper gap positioned in the lower angle assembly; a lower angle assembly, the lower angle assembly including a lower gap positioned in the lower angle assembly; and at least one of a web member; and a bridge web member. Wherein the at least one of the web member and the bridge web member is positioned within the gap of at least one of the upper angle assembly and the lower angle assembly.

A further aspect of the truss includes the upper angle assembly includes a first upper angle bar and a second upper angle bar, with the upper gap positioned between adjacent legs of the first angle bar and second angle bar.

Another aspect of the disclosure includes any of the preceding aspects, and the lower angle assembly includes a first lower angle bar and a second lower angle bar, with the lower gap positioned between adjacent legs of the first angle bar and second angle bar.

Another aspect of the disclosure includes any of the preceding aspects, and the lower angle assembly includes a first lower angle bar and a second lower angle bar, with the lower gap positioned between adjacent legs of the first angle bar and second angle bar.

Another aspect of the disclosure includes any of the preceding aspects, and the web member includes a first lateral end; a second lateral opposed end, and an angled interconnecting web piece between the first lateral end and second lateral opposed end.

Another aspect of the disclosure includes any of the preceding aspects, and the angled interconnecting web piece extends at an angle $\alpha$ (alpha) from the first lateral end and second lateral opposed end.

Another aspect of the disclosure includes any of the preceding aspects, and the angle $\alpha$ (alpha) is in a range between about 0° and about 90°.

Another aspect of the disclosure includes any of the preceding aspects, and the bridge web includes a first upper web piece; a second upper web piece, lower web piece; and angled interconnecting web pieces, each angled interconnecting web pieces connected to one of the first upper web piece and a second upper web piece at one end and the lower web piece at its other end.

Another aspect of the disclosure includes any of the preceding aspects, and each angled interconnecting web pieces extends at an angle $\alpha$ (alpha) from the first upper web piece and a second upper web piece at one end and the lower web piece at its other end.

Another aspect of the disclosure includes any of the preceding aspects, and the angle $\alpha$ (alpha) is in a range between about 0° and about 90°.

Another aspect of the disclosure includes any of the preceding aspects and the truss including the web member and the bridge web member.

Another aspect of the disclosure includes any of the preceding aspects, and the upper angle assembly includes a first upper angle bar and a second upper angle bar, with the upper gap positioned between adjacent legs of the first angle bar and second angle bar.

Another aspect of the disclosure includes any of the preceding aspects, and the lower angle assembly includes a first lower angle bar and a second lower angle bar, with the lower gap positioned between adjacent legs of the first angle bar and second angle bar.

Another aspect of the disclosure includes any of the preceding aspects, and the lower angle assembly includes a first lower angle bar and a second lower angle bar, with the lower gap positioned between adjacent legs of the first angle bar and second angle bar.

Another aspect of the disclosure includes any of the preceding aspects, and the web member includes a first lateral end; a second lateral opposed end, an angled interconnecting web piece between the first lateral end and second lateral opposed end.

Another aspect of the disclosure includes any of the preceding aspects, and the angled interconnecting web piece extends at an angle α (alpha) from the first lateral end and second lateral opposed end.

Another aspect of the disclosure includes any of the preceding aspects, and the angle α (alpha) is in a range between about 0° and about 90°.

Another aspect of the disclosure includes any of the preceding aspects, and the bridge web includes a first upper web piece; a second upper web piece, a lower web piece; and at least two angled interconnecting web pieces, each angled interconnecting web piece connected to one of the first upper web piece and a second upper web piece at one end and the lower web piece at its other end.

An aspect of the embodiments sets forth a web member. The web member includes a first upper web piece; a second upper web piece, a lower web piece; and at least two angled interconnecting web pieces, each angled interconnecting web piece connected to one of the first upper web piece and a second upper web piece at one end and the lower web piece at its other end.

An aspect of the embodiments sets forth a web member. The web member includes a first lateral end; a second lateral opposed end, an angled interconnecting web piece between the first lateral end and second lateral opposed end.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
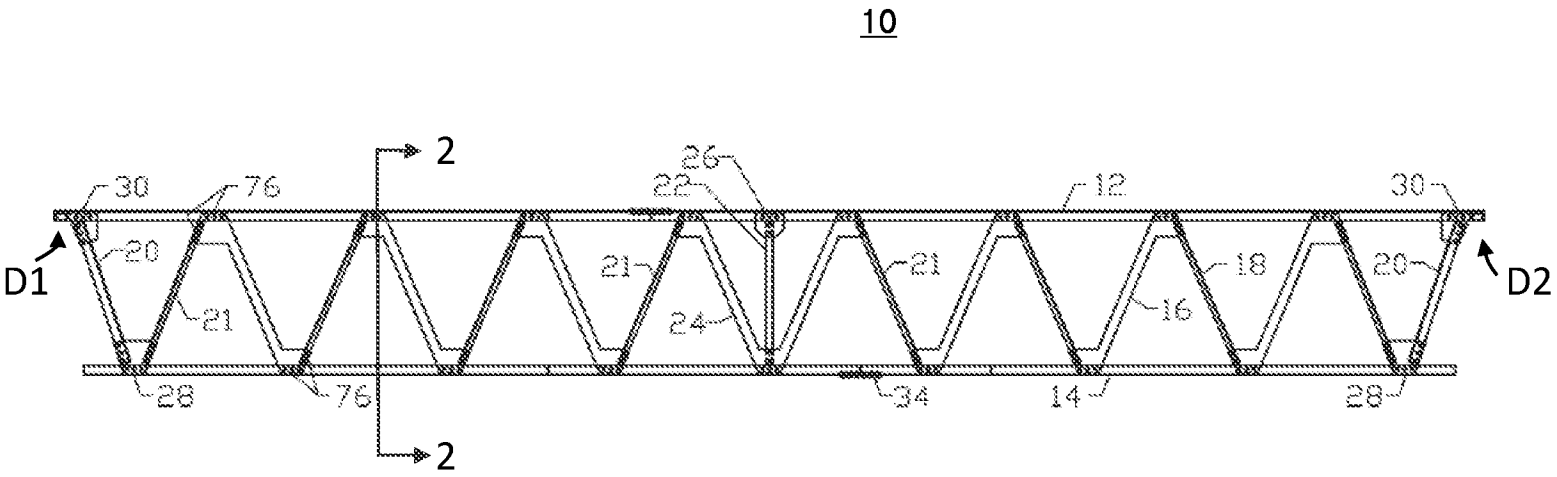
FIG. 1 is a plan schematic illustration of a truss in accordance with aspects of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant components within trusses and truss systems. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

It is often required to describe parts that are positioned at differing positions with regard to each other. As set forth herein, orientations will be with respect to the figures. Thus, if an element or part is described as "above" another element or part, that will be with respect to the figure, and is not to be construed as limiting the overall structure. The orientation of elements and parts of an overall structure are not intended to be construed by this description, as the orientation description is merely to facilitate the overall description of the embodiments.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Figure 2:
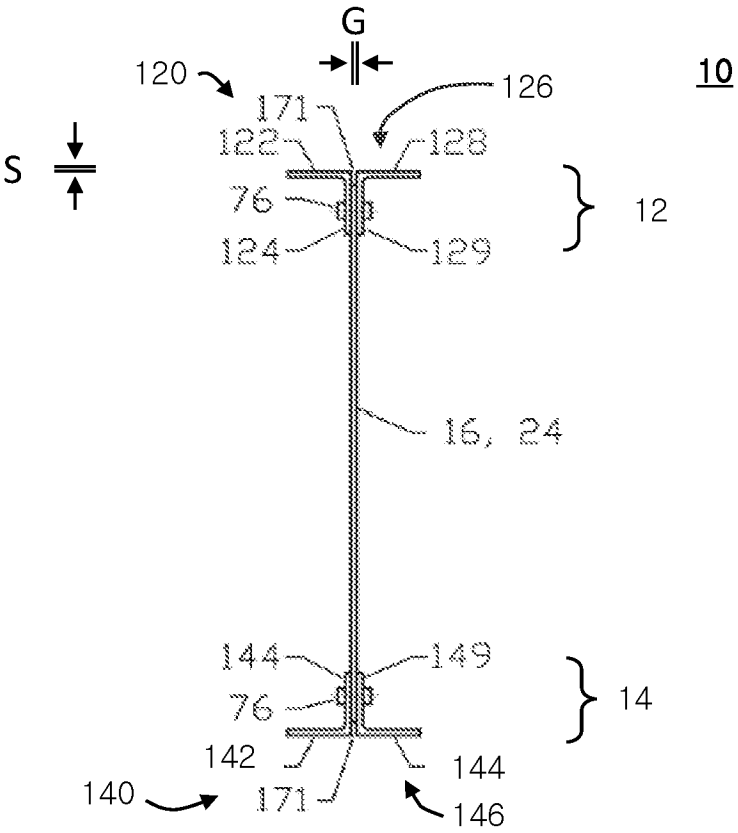
FIG. 2 is a sectional view of the truss in accordance with aspects of the disclosure taken along line 2-2.

With respect to FIGS. 1 and 2, a truss 10 is provided for structural support, for example structural support in a structure or building. Truss 10 includes an upper angle assembly 12, and a lower angle assembly 14. Web member 16 interconnects the upper angle assembly 12 and lower angle assembly 14. Also, interconnecting members 18 are positioned connecting one end of web member 16 to another end of an adjacent web member 16.

At least one "bridge" web 24 (bridge web 24) is positioned in truss 10. As illustrated bridge web 24 is approximately at a center of truss 10. An aspect of the embodiment can include a single bridge web 24. In another aspect of the embodiment, truss 10 can include more than one bridge web 24 positioned along the truss 10. For example, and in no way limiting of the embodiment, where bridge web 24 may be positioned equally spaced along the truss 10. In another aspect of the embodiment, truss 10 can include multiple bridge webs 24 that can be positioned along truss 10 as necessary by structural requirements of the truss and the structure in which it supports. In aspects as embodied by the disclosure, bridge webs 24 may be evenly positioned along truss 10, or irregularly positioned along truss 10, as necessitated by structural requirements of the truss and the structure in which truss 10 supports.

Truss 10 also includes and interconnecting members 20 positioned at respective ends of truss 10 as illustrated in FIG. 1. Interconnecting members 20 may connect to one or more web member 16, connect to bridge web 24, and/or to gussets 28, 30 of truss 10 at end(s) of truss 10. Interconnecting members 20 can be configured with bolt holes (not illustrated in detail for ease of understand) that align with corresponding bolt holes on one or more web member 16, connect to bridge web 24, and/or to gussets 28, 30, as described hereinafter.

Further, an aspect of the embodiments includes a connecting member 21 extending between upper angle assembly 12 and lower angle assembly 14. Connecting member 21 may connect to one or more web member 16, connect to a bridge web 24, and/or to gussets 28, 30 of truss 10. Connecting member 21 can be configured with bolt holes (not illustrated in detail for ease of understand) to align with corresponding bolt holes on one or more web member 16, connect to bridge web 24, and/or to gussets 28, 30, as described hereinafter.

In another aspect of the embodiment, upper angle assembly 12 extends a further longitudinal direction than lower angle assembly 14 (FIG. 1). Thus, at each end of truss 10 an overhang D1, D2 exists where upper angle assembly 12 laterally extends to and beyond lower angle assembly 14. Overhang D1, D2 enables end of upper angle assembly 12 to rest on a building or structure's supporting column to support truss 10 thereon. Moreover, ends of lower angle assembly 14 of truss 10 can be attached to the same supporting column, beam, support B, or the like, if desired. In certain aspects of the embodiments, connection of lower angle assembly 14 to a supporting column can provide further stability as necessitated by the structural and mechanical requirements associated with truss 10.

In aspect of the embodiments, end interconnecting member 20, connecting member 21, and optional vertical reinforcing member 22 can also be provided in a thickness necessitated to meet structural and design requirements of the truss 10 and structure that the truss 10 may be provided in for use. As a non-limiting illustrative aspect, the thickness of the end interconnecting member 20, connecting member 21, and optional vertical reinforcing member 22 may be provided in a range between about 0.25 cm and about 3.2 cm (0.1 inch to about 1.25 inches). In other aspects of the embodiments, end interconnecting member 20, connecting member 21, and optional vertical reinforcing member 22 may be provided in a range between about 0.5 cm and about 2.54 cm (0.2 inch to about 1.0 inch). Moreover, end interconnecting member 20, connecting member 21, and optional vertical reinforcing member 22 thickness may be provided in a range between about 0.75 cm and about 1.9 cm (0.3 inch to about 0.75 inch), and in a further aspect of the embodiments, end interconnecting member 20, connecting member 21, and optional vertical reinforcing member 22 thickness may be provided in a range between about 1 cm and about 1.5 cm (about 0.4 inch to about 0.6 inch). In another aspect, end interconnecting member 20, connecting member 21, and optional vertical reinforcing member 22 thickness may be provided at about 1.3 cm (0.5 inch).

With respect to FIG. 2, a side sectional of truss 10 taking a long line 2-2 of FIG. 1 is illustrated. Upper angle assembly 12 comprises a left upper truss angle bar 120, and a right upper truss angle bar 126. Upper truss angle bar 120 includes a horizontal leg 122 and a vertical leg 124. Similarly, right upper truss angle bar 126 includes a horizontal leg 128 and a vertical leg 129.

In a similar fashion, as illustrated in FIG. 2, lower truss angle assembly 14 includes a left lower truss angle bar 140 and a right lower angle bar 146. Left lower truss angle bar 140 includes a horizontal leg 142 and a vertical leg 144. Right lower angle bar 146 includes a horizontal leg 146 and a vertical leg 149.

As noted above, with the description of FIG. 1, an aspect of the embodiment includes bolt holes 76 provided in each of the upper angle member assembly 12 and lower angle assembly 14. Bolt holes 76 interconnect with web member 16, bridge web 24, and gussets 26, 28, and 30.

Figure 3:
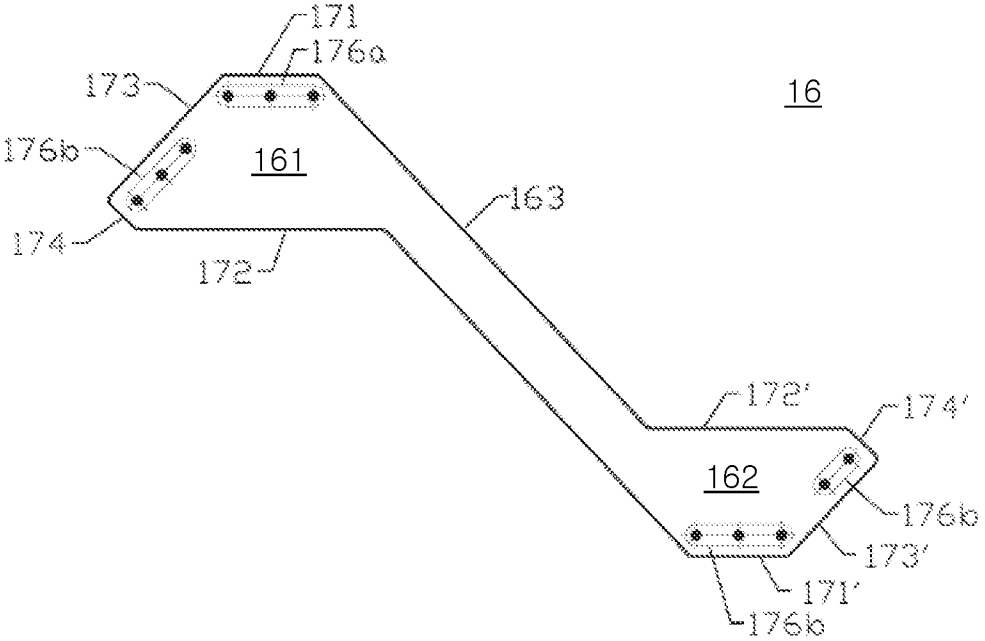
FIG. 3 is a side schematic illustration of a web member of a truss in accordance with aspects of the disclosure.

As is illustrated in FIG. 2, web member 16 is interdisposed between vertical legs 124, 129 of upper angle assembly 12 and vertical legs 144, 149 of lower angle assembly 14. Bolts can be inserted through bolt holes 76 in upper angle assembly 12 and bolt holes 76 in lower angle assembly 14 through bolt holes 176, as illustrated in FIG. 3. Bolts can secure web member 16 to upper angle assembly 12 and lower angle assembly 14

In one aspect of the embodiments, bolts are used to connect member 16 interconnecting member 18, interconnecting member 20, and optionally vertical reinforcing member 22, a central web 24, center gusset 26, and gusset 28, and end upper angle gusset 30. However, aspects of the embodiments may include other connection and joining of these members. For example, and in no way limiting of the embodiments, web member 16, interconnecting member 18, interconnecting member 20, optional vertical reinforcing member 22, bridge web 24, center gusset 26, end gusset 28, and upper angle gusset 30 can be secured to each other by welding, brazing, and other suitable connection configurations, now known or hereinafter developed, which may provide structural integrity to truss 10 to support the intended load.

Moreover, various components as described herein are configured to be connected to each other. As embodied by the disclosure, connections between components of truss 10 can be by bolt, and further secured by weldments or other joining and connecting schema or joining technologies, now known or hereinafter developed, in addition to bolts. Additionally, members of truss 10 can be connected by bolts alone and other members can be connected by only welds or other joining/connecting schema or joining technologies now known or hereinafter developed.

Referring to FIG. 2, the web members 16 and bridge web 24, as well as gussets 26, 28, 30 (as described hereinafter) are configured to be positioned within a gap G formed by between upper truss left angle bar 120 and right upper truss angle bar 126 of upper angle assembly 12. In a similar manner, web members 16 and bridge web 24, as well as gussets 26, 28, 30 (as described hereinafter) are configured to be positioned within a gap G formed between the lower angle assembly 14 horizontal members horizontal legs or 142, 146 of lower truss left angle bar 140 and right lower truss angle bar 146.

As illustrated in FIG. 2, web member 16 and bridge web 24, as well as gussets 26, 28, 30 (as described hereinafter), are configured to terminate before an outer surface of horizontal members horizontal legs 122, 126 or 142, 146 of upper or lower angle assemblies 12 and 14, respectively. Thus, space S is positioned and exists between the outer surface of horizontal members 122, 128 and 142, 146 at respective upper or lower angle assemblies 12 and 14. Accordingly, any elements positioned against horizontal members horizontal legs 122, 126 or 142, 146 on either of the upper angle assembly 12 or the lower angle assembly 14 can be coplanar or evenly positioned on horizontal leg members 124, 128 of upper angle assembly 12 and lower angle assembly 14. Therefore a load can be evenly supported on either of upper angle assembly 12 and lower angle assembly 14.

In FIG. 2, web member 16 includes first lateral end 161 to be positioned and connect with upper angle assembly 12. Accordingly, first lateral end 161 includes a horizontal surface 171 positioned between upper truss member left angle bar 120 and upper truss member left angle bar 126 of web member 16. Further, as noted above and with respect to FIGS. 2 and 3, horizontal coplanar web member surface 171 is a distance S (FIG. 2) below the vertical or horizontal surfaces 122 and 128 of upper truss left and right angle bars 120 and 126, respectively.

FIG. 3 illustrates an exemplary configuration of web member 16. In accordance with certain aspects of the embodiment, web member 16 includes a first lateral end 161 and a second lateral opposed end 162. Web member 16 further includes an angled interconnecting web piece 163 that extends add an angle α (alpha) between first lateral end 161 of web member 16 and a second lateral opposed end 162 of web member 16.

As illustrated in FIG. 3, angle α (alpha) is approximately 45°. This angle α dimension is merely illustrative of the possible orientations of angled interconnecting web piece 163 between first lateral end 161 and second opposed lateral end 162 of web member 16. Aspects of the embodiment include, but are not limited to, angle α being in a range between zero and 90°, in a range between about 10 and about 80°, in a range between about 20 and about 70°, in a range between about 33 and about 67°, in a range between about 40 and about 50° and any degrees there between. In one aspect of the embodiments, angle α is about 45°. The configuration of angle α of web member 16 may be fabricated in varying degrees for coordination of mechanical, electrical, and plumbing (MEP) coordination, as discussed hereinafter. Additionally, configuration of angle α of web member 16 may be dependent and necessitated by loads that truss 10 are intended to support.

In FIG. 3, first lateral end 161 and second lateral end 162 each are configured to attach to an end connected to angled interconnecting web piece 163. Also, as embodied by the disclosure, first lateral end 161 and second lateral end 162 each are configured with "free ends" at side 173, 174 and 173' and 174' oppositely extending with respect to each other, referred to as upper free end and lower free end, respectively.

Web member 16 is substantially symmetrical. Thus noting FIG. 3, web member 16 is oriented as if on the left "L" side of truss 10 (FIG. 1). However, if web member 16 is rotated so first lateral end 161 and horizontal surface 171 are now positioned "below" with horizontal surface 171 being the lowest part of web member 16, web member 16 is now oriented as if on the right R side of truss 10 (FIG. 1).

Additionally, first lateral end 161 of web member 16 includes an angled surface 173 that lies substantially collinearly with interconnecting member 18. Furthermore, as illustrated in FIG. 3, bolt holes **176*b* are provide approximate surface 173 and these bolt holes 176*b* engage with similar bolt holes on interconnecting member 18**.

As illustrated in FIG. 3, bolt holes **176*a* are provided proximate the horizontal surface 171 to engage and align with bolt holes 76 of truss 10. Accordingly, if bolts (not illustrated for ease of illustration and description) are used to secure web member 16 to truss 10, bolts align and can secure web member 16 therebetween the angle bars of upper truss member 120. Furthermore, as illustrated in FIG. 3, bolt holes 176*b* are provide approximate surface 173 and these bolt holes 176*b* engage with similar bolt holes on interconnecting member 18**.

First lateral end of 161 of web member 16 also includes an angled surface 174 in line with interconnecting member 18. Angled surface (i.e., edge) 174 extends to inward facing horizontal surface (i.e., edge) 172 opposed to outward facing horizontal surface (i.e., edge) 171. Additionally, second lateral end 162 of web member 16 includes an angled surface 173' that lies substantially collinearly with interconnecting member 18.

As illustrated in FIG. 3, bolt holes **176*b* are provided proximate the horizontal surface 171' to engage and align with bolt holes 76 of truss 10. Accordingly, if bolts (not illustrated for ease of illustration and description) are used to secure web member 16 to truss 10, bolts align and can secure web member 16 therebetween left and right angle bars 140 and 146, respectively of lower truss member 140. Furthermore, as illustrated in FIG. 3, bolt holes 176*b* are provide approximate surface 173' to engage with similar bolt holes on interconnecting member 18**.

Second lateral end 162 of web member 16 also includes an angled surface 174' in line with interconnecting member 18. Angled surface 174' extends to horizontal surface 172' opposed to horizontal surface 171'.

Figure 4:
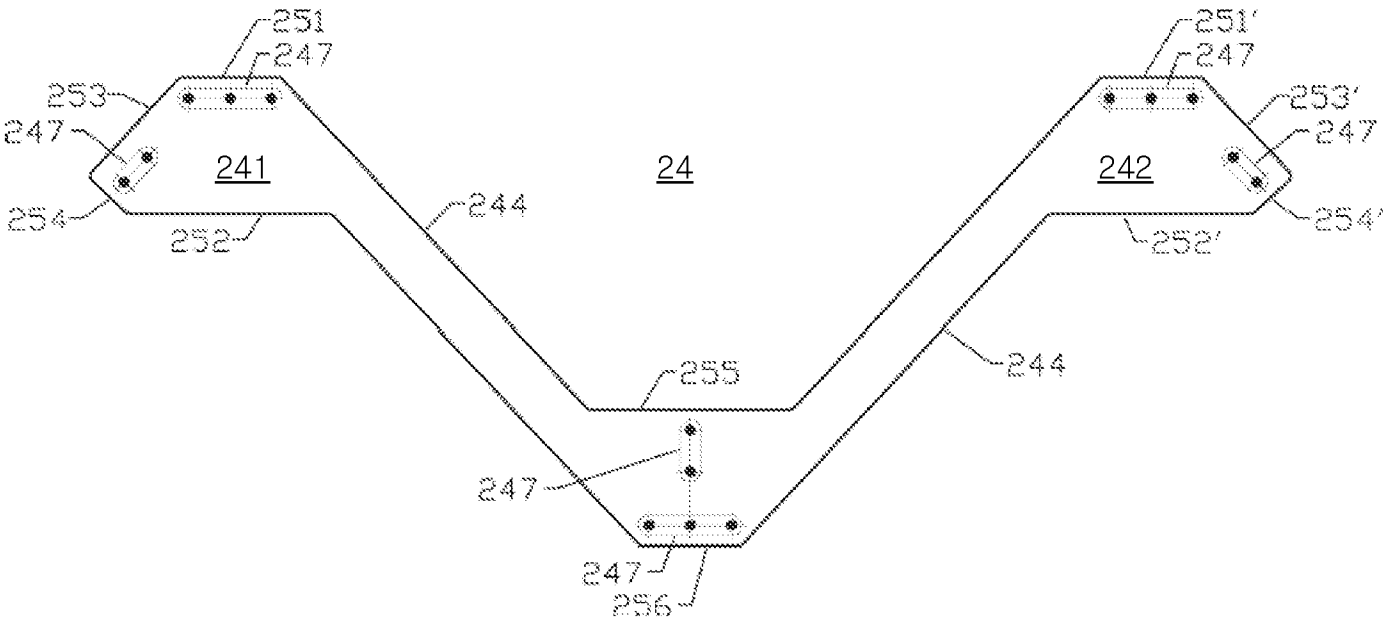
FIG. 4 is a side schematic illustration of a bridge web of a truss in accordance with aspects of the disclosure.

FIG. 4 illustrates an exemplary configuration of bridge web 24. Bridge web 24 includes two upper web pieces 241, 242. Upper web pieces 241, 242 are similar in configuration as first end 161 of web member 16. As illustrated in FIGS. 1 and 4, bridge web 24 and upper web pieces 241, 242 are oppositely oriented with their "free end" oppositely extending towards ends of truss 10. Also, bridge web 24, upper web piece 241, and upper web piece 242 are oppositely configured with similar structure as first end 161.

In FIG. 4, first upper web piece 241 includes a configuration to connect with upper angle assembly 12. Accordingly, first upper web piece 241 includes a horizontal surface 251 positioned between upper truss member left angle bar 120 and upper truss member left angle bar 126. Further, as noted above and with respect to FIG. 2, horizontal coplanar web member surface 251 can be a distance S below the vertical or horizontal surfaces 122 and 128 of upper truss left and right members 120 and 126.

FIG. 4 also illustrates second upper web piece 242 including a configuration to connect with upper angle assembly 12, but with a free end extending to an opposite end as free end of first upper web piece 241. Accordingly, second upper web piece 242 includes a horizontal surface 251' positioned between upper truss member left angle bar 120 and upper truss member left angle bar 126. Further, as noted above and with respect to FIG. 2, horizontal coplanar web member surface 251' can be a distance S below the vertical or horizontal surfaces 122 and 128 of upper truss left and right members 120 and 126.

As illustrated in FIG. 4, the first upper web piece 241 second upper web piece 242 are connected to legs or angled interconnecting web pieces 244 at an angle α (alpha). Angle α (alpha) is approximately 45°. This angle α dimension is merely illustrative of the possible orientations of legs or angled interconnecting web pieces 244 between first upper web piece 241 second upper web piece 242 of bridge web 24. Aspects of the embodiment include but are not limited to angle α being in a range between about zero and about 90°, in a range between about 10 and about 80°, in a range between about 20 and about 70°, in a range between about 33 ad about 67°, in a range between about 40 and about 50° and any degrees there between. In one aspect of the embodiments, angle α is about 45°. The configuration and angles α of bridge web 24 may be fabricated in varying degrees for coordination of mechanical, electrical, and plumbing (MEP) coordination, as discussed hereinafter. Additionally, configuration of angle α of web member 16 may be dependent and necessitated by loads that truss 10 are intended to support.

In FIG. 4, the first upper web piece 241 second upper web piece 242 of bridge web 24 each are configured with "free ends" at side 253, 254 and 253', 254' that are configured to be oppositely extending with respect to each other.

Bridge web 24 is substantially symmetrical around a center axis of lower web piece 243. Lower web piece 243 is configured to engage with lower angle assembly 14. Lower web piece 243 can be configured to be positioned within a gap G formed between the lower angle assembly 14 horizontal members horizontal legs or 142, 146 of lower truss left angle bar 140 and right lower truss angle bar 146 (see FIG. 2).

As illustrated in FIG. 4, bolt holes 247 are provided proximate the horizontal surface 251 and horizontal surface 251' to engage and align with bolt holes 76 of truss 10. Accordingly, if bolts (not illustrated for ease of illustration and description) are used to secure web member 16 to truss 10, bolts align and can secure web member 16 therebetween the angle bars of upper truss member 120. Furthermore, as illustrated in FIG. 3, bolt holes 247 are provided proximate surface 253 and surface 253' configured to engage with similar bolt holes on connecting member 21.

Bridge web 24 also includes legs or angled interconnecting web pieces 244 that connect upper web pieces 241 and 242 to lower web piece 243. Lower web piece 243 engages with angled interconnecting web pieces 244 at angle α (alpha) as set forth in FIG. 4. Also, angle α (alpha) as set forth in FIG. 4, also represents the angular orientation of angled interconnecting web pieces 244 with respect to upper web pieces 241 and 242. As illustrated in FIG. 4, angle α (alpha) is also the angular orientation of approximately 45°.

Angle α's dimension is merely illustrative of the possible orientations of angled interconnecting web pieces 244 between upper web pieces 241 and 242 of bridge web 24. Angle α can be varied in fabrication due to MEP coordination needs, as discussed hereinafter. A change in angle α between upper web pieces 241 and 242 and angled interconnecting web pieces 244, may cause a corresponding angle change in equal degrees to angle α between lower web piece 243 and angled interconnecting web pieces 244. Thus, aspects of the embodiment include, but are not limited to angle α being in a range between about zero and about 90°, in a range between about 10 and about 80°, in a range between about 20 and about 70°, in a range between about 33 and about 67°, in a range between about 40 and about 50° and any degrees there between. In one aspect of the embodiments, angle α is about 45°. Additionally, configuration of angle α of web member 16 may be dependent and necessitated by loads that truss 10 are intended to support.

Center interconnecting web 244 leads to lower web piece 243. Lower web piece 243 is positioned in lower angle assembly 14 between lower angle members 140 and 146, as best illustrated in FIG. 2. Lower web piece 243 can include lower surface 256 which is positioned between the vertical members 144 and 149 of lower angle assembly 14, Surfaces 251 and 251' extend and terminate a distance S before the horizontal surfaces of lower angle member assembly 14. Lower web piece 243 includes bolt holes 247 that align with bolt holes 76 in lower angle assembly 14 as illustrated in FIG. 1. Lower web piece 243 also includes bolt holes **247*v*. Bolt holes 247*v* (FIG. 4), in certain aspects of the embodiment, engage the optional vertical reinforcing member 22 (FIG. 1**).

Figure 5:
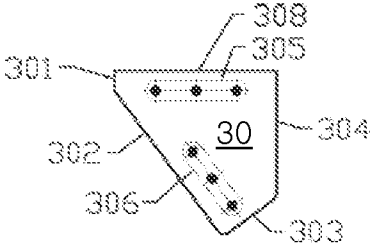
FIG. 5 is a side schematic illustration of a truss end upper angle gusset, in accordance with aspects of the disclosure.

Truss end upper gusset 30 is illustrated in FIG. 5. Truss end upper gusset 30 can be provided in a thickness necessitated to meet structural and design requirements of truss 10 and structure that truss 10 may be provided in for use. Truss end upper gusset 30 can include a vertical side 301; an angled side 302, which extends parallel with end interlocking member 20; a side 303; and a vertical side 304. Top side 305 is positioned in gap G between upper truss member left angle bar 120 and upper truss member right angle bar 126. In certain aspects of the embodiments, truss end upper gusset 30 can include bolt holes 306, **306*b* in top side 305 and angled side 302. Bolt holes 306*b* on angled side 302 align with bolt holes in interlocking member 20 to secure end interlocking member 20 to truss end upper gusset 30. Bolt holes 306 at top side 305 align with bolt holes 75 in upper truss member left angle bar 120 and upper truss member right angle bar 126 of upper angle bar assembly 12. Thus, as embodied by the disclosure, truss end upper gusset 30 when secured to upper truss member left angle bar 120 and upper truss member right angle bar 126 of upper angle bar assembly 12 can secure end interconnecting member 20 to truss 10. In an aspect of the embodiments, securing includes aligning securing of end interconnecting member 20 to upper truss member left angle bar 120 and upper truss member right angle bar 126 of upper angle bar assembly 12**.

Figure 6:
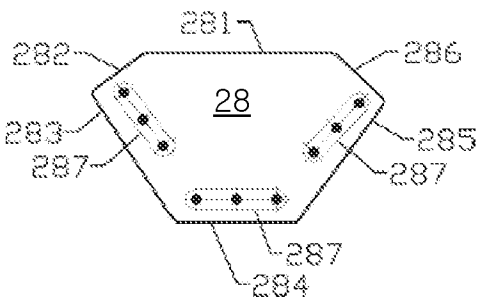
FIG. 6 is a side schematic illustration of a truss end lower angle gusset, in accordance with aspects of the disclosure.

Truss end lower gusset 28 is illustrated in FIG. 6. As truss end lower gusset 28 can be used at either end of truss 10. Right most end lower gusset 28 in FIG. 1 will be described for purposes of understanding, but for illustrative purposes only, and is not intended to limit the embodiments in any way. Truss end lower gusset 28 can be provided in a thickness necessitated to meet structural and design requirements of the truss 10 and structure that truss 10 may be provided in for use.

Truss end lower gusset 28 can include a top horizontal side 281; an outwardly extending side 282 (left side in FIG. 6) extending from top horizontal side 281; an inwardly extending angled piece 283 (left side in FIG. 6); bottom horizontal side 284; and an outwardly extending side 286 (right side in FIG. 6) extending from top horizontal side 281; inwardly extending angled piece 285 (right side in FIG. 6). Bottom horizontal side 284 is positioned in gap G between lower truss member left angle bar 140 and lower truss member right angle bar 146. In certain aspects of the embodiments, end lower gusset 28 can include bolt holes 287 at bottom side 284 and angled sides 283 and 285, respectively. Bolt holes 287 on angled side 283 align with bolt holes in end interlocking member 20 to secure end interlocking member 20 to end lower gusset 28. Bolt holes 287 at bottom side 284 align with bolt holes 75 in lower truss member left angle bar 140 and lower truss member right angle bar 146 of lower angle bar assembly 14. Additionally, bolt holes 287 on angled side 285 can attach to connecting member 21.

As embodied by the disclosure, end lower gusset 28 is symmetrical about a center axis C. Symmetry of end lower gusset 28 allows for end lower gusset 28 to be positioned on either a left side/end or right side/end of truss 10. This dual usage of end lower gusset 28 at either end of truss 10 reduces overall design, part requirements for truss 10 and thus costs.

Truss end lower gusset 28, when secured to lower truss member left angle bar 140 and lower truss member right angle bar 146 of lower angle bar assembly 14, can secure end interconnecting member 20 and connecting members 21 to truss 10. This securing includes securing of end interconnecting member 20 to lower truss member left angle bar 140 and lower truss member right angle bar 146 of lower angle bar assembly 14.

Figure 7:
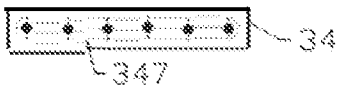
FIGS. 7 and 8 are side schematic illustrations of a shear plates for a truss, in accordance with aspects of the disclosure.
Figure 8:
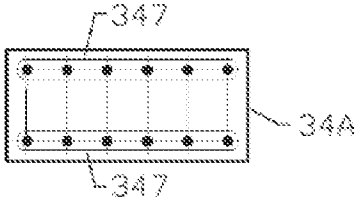

FIGS. 7 and 8 illustrate two embodiments of splice plates, 34 and 34A. Splice plates 34 and 34A are used to connect lengths of angle bars if a span required for a truss is longer than lengths of one or both of upper angle assembly 12 and lower angle assembly 14. Upper angle assembly 12 may not require a splice plate if upper surfaces of vertical upper truss angle bars 122 and 128 are preferred to be planar. Accordingly, any surface, roof member, or other structural element positioned on upper surfaces of vertical upper truss angle bars 122 and 128 can lie substantially totally on upper surfaces of vertical upper truss angle bars 122 and 128.

As illustrated in FIGS. 7 and 8, splice plates 34 and 34A are substantially planar pieces of stock material. The stock material for splice plates 34 and 34A, as embodied by the disclosure, can be provided in a thickness necessitated to meet structural and design requirements of the truss 10 and structure that the truss 10 will be provided in for use. Further, splice plates 34 and 34A include a plurality of bolt holes 347. Bolt holes 347 are positioned in rows and are positioned on splice plates 34 and 34A to align with bolt holes 76 (not illustrated for ease of understanding) on one or both of upper angle assembly 12 and lower angle assembly 14. Accordingly, splice plates 34 and 34A enable truss 10 to be provided with a span distance, which may be longer than angle bars that form one or both of upper angle assembly 12 and lower angle assembly 14.

Figure 9:
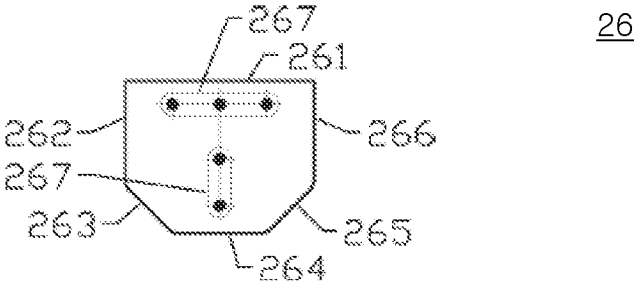
FIG. 9 is a side schematic illustration of a truss center gusset, in accordance with aspects of the disclosure.

FIG. 9 illustrates a center gusset 26 for truss 10. Center gusset 26 is positioned to align with optional vertical reinforcing member 22 and lower web piece 243 of bridge web 24 (FIG. 1). Center gusset 26, as embodied by the disclosure, can include an upper horizontal side 261, vertical sides 262 and 266 extending from upper horizontal side 261, a lower horizontal side 264 that is a length smaller that a length of upper horizontal side 261, and interconnecting angled sides 263 and 265 connecting vertical sides 262 and 266. Lower web piece 243 can extend from upper horizontal side 261 to a lower horizontal side 264.

Center gusset 26 includes bolt holes 267. One set of bolt holes 267 extends at the upper horizontal side 261 and is configured to align with bolt holes 67 in upper angle assembly 12. Thus, center gusset 26 can be positioned within gap G formed between upper truss left angle bar 120 and right upper truss angle bar 126 of upper angle assembly 12. Further, a line of bolt holes 267 extends along center line CL (FIG. 9) of center gusset 26. In accordance with an aspect of the embodiments, bolt holes 267 extends along center line CL of center gusset 26 from upper horizontal side 261 to a lower horizontal side 264 are configured to align with bolt holes in optional vertical reinforcing member 22.

Figure 10:
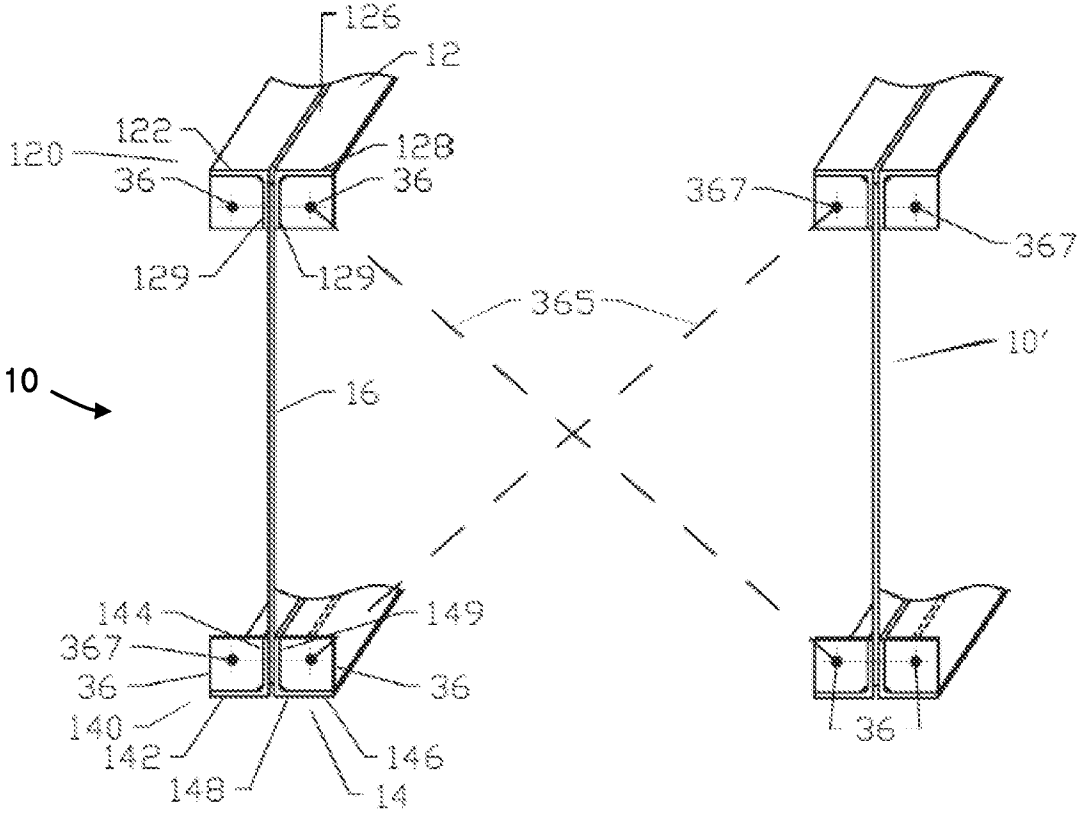
FIG. 10 is a schematic part-sectional illustration of two trusses connected at splice plates, in accordance with aspects of the disclosure.

FIG. 10 illustrates a side sectional view of truss 10 and an adjacent truss 10' with shear plates 36. When multiple trusses 10 are used in a structure, depending on load intended to be supported by a truss 10 and trusses 10, 10', and the mechanical designs associated with structure, adjacent trusses, 10, 10' may be interconnected to each other.

Accordingly, in an aspect of the embodiments, as illustrated in FIG. 10, shear plates 36 may be provided on upper angle assembly 12 and lower angle assembly 14. Shear plates 36 may be provided bolt holes 367. Shear plates 36 are configured to align with and connect to cross members 365 that extend from truss 10 and adjacent truss 10'. Cross members 365 are illustrated in dashed lines, as the configuration of cross members 65 are not limiting with respect to truss 10. Cross members 365 may be formed from flat stock, angle bars, U-shaped or C-shaped bars, tubular members that may include square, circular, or other tubular cross-sectional configurations; or other structural structures, now known or hereinafter developed. In certain aspects of the embodiments, cross members 65 include a bolt hole that aligns with bolt hole 367 of shear plate 36. Thus, as embodied by the disclosure, cross members 365 when connected to two adjacent trusses 10, 10', may provide structural rigidity to a structure employing wo adjacent trusses 10, 10', as embodied by the disclosure. Moreover, another aspect of the embodiments, includes use of cables for tension members/cords in addition to or in place of cross members 365. Moreover, the use of cables for tension members/cords in addition to or in place of cross members 365 will not experience reverse loading in use.

As described herein, truss 10 and its components that are provided with bolt holes are illustrated with a number of bolt holes. However, the number of bolt holes illustrated in the figures is merely illustrative of the possible number of bolt holes that could be included in any component of truss 10. More, less, or the illustrated configuration and number of bolt holes can vary, as embodied by the disclosure, to meet structural and design requirements of the truss 10 and structure to which truss 10 will be provided in for use.

In certain aspects of the embodiments, upper angle assembly 12 and lower angle assembly 14 are provided in a thickness necessitated to meet structural and design requirements of truss 10 and structure that truss 10 may be provided in for use. As a non-limiting illustrative aspect, the thickness T (FIG. 2) of the angle members may be provided in a range between about 0.25 cm and about 3.2 cm (about 0.1 inch to about 1.25 inches). In other aspects of the embodiments, thickness T may be provided in a range between about 0.5 cm and about 2.54 cm (about 0.2 inch to about 1.0 inch). Moreover, thickness T may be provided in a range between about 0.75 cm to about 1.9 cm (about 0.3 inch to about 0.75 inch), and in a further aspect of the embodiments, thickness T may be provided in a range between about 1 cm and about 1.5 cm (about 0.4 inch to about 0.6 inch). In another aspect, thickness T may be provided at about 1.3 cm (0.5 inch).

In certain aspects of the embodiments, each of web members 16 and 24 can also be provided in a thickness necessitated to meet structural and design requirements of the truss 10 and structure that truss 10 can provided in for use. As a non-limiting illustrative aspect, the thickness of the web members 16 and bridge web 24 may be provided in a range between about 0.25 cm and about 3.2 cm (about 0.1 inch and about 1.25 inches). In other aspects of the embodiments, web member 16 and bridge web 24 thickness may be provided in a range between about 0.5 cm and about 2.54 cm (about 0.2 inch and about 1.0 inch). Moreover, web member 16 and bridge web 24 thickness may be provided in a range between about 0.75 cm and about 1.9 cm (about 0.3 inch and about 0.75 inch), and in a further aspect of the embodiments, thickness may be provided in a range between about 1 cm and about 1.5 cm (about 0.4 inch and about 0.6 inch). In another aspect, web member 16 and bridge web 24 thickness may be provided at about (0.5 inch).

In another aspect of the embodiments, end interconnecting member 20, connecting member 21, and optional vertical reinforcing member 22 can also be provided in a thickness necessitated to meet structural and design requirements of truss 10 and structure that truss 10 may provided in for use. As a non-limiting illustrative aspect, thickness of end interconnecting member 20, connecting member 21, and optional vertical reinforcing member 22 may be provided in a range between about 0.25 cm and about 3.2 cm (about 0.1 inch and about 1.25 inches). In other aspects of the embodiments, end interconnecting member 20, connecting member 21, and optional vertical reinforcing member 22 may be provided in a range between about 0.5 cm and about 2.54 cm (about 0.2 inch and about 1.0 inch). Moreover, end interconnecting member 20, connecting member 21, and optional vertical reinforcing member 22 thickness may be provided in a range between about 75 cm and about 1.9 cm (about 0.3 inch and about 0.75 inch), and in a further aspect of the embodiments, end interconnecting member 20, connecting member 21, and optional vertical reinforcing member 22 thickness may be provided in a range between 1 cm to about 1.5 cm (about 0.4 inch and about 0.6 inch). In another aspect, end interconnecting member 20, connecting member 21, and optional vertical reinforcing member 22 thickness may be provided at about 1.3 cm (0.5 inch).

Truss 10 can be formed of any suitable construction material, now known or hereinafter developed. In certain aspects of the embodiments, truss 10 includes a metal. In one aspect of the embodiments, truss 10 includes structural steels. For example, and not intending to limit the embodiments in any manner, structural steels may include at least one of carbon steels, steels with composite additives or coatings, high strength low alloy steels, corrosion resistant high strength low alloy steels, quenched and tempered alloy steels, and forged steels, and any other metal or steel now known or hereinafter developed.

In certain aspects of the embodiments, angle member assembly 12 and angle member assembly 14 can be provided in a thickness necessitated to meet structural and design requirements of truss 10 and a structure that truss 10 will be provided in for use. As a non-limiting illustrative aspect, the thickness T (FIG. 2) of the angle members may be provided in a range between about 0.25 cm and about 3.2 cm (about 0.1 inch and about 1.25 inches). In other aspects of the embodiments, thickness T may be provided in a range between about 0.5 cm and about 2.54 cm (about 0.2 inch and about 1.0 inch). Moreover, thickness T may be provided in a range between about 0.75 cm and about 1.9 cm (about 0.3 inch and about 0.75 inch), and in a further aspect of the embodiments, thickness T may be provided in a range between 1 cm and about 1.5 cm (about 0.4 inch and about 0.6 inch). In another aspect, thickness T may be provided at about 1.3 cm (0.5 inch).

In certain aspects of the embodiments, each of web members 16 and 24 can also be provided in a thickness necessitated to meet structural and design requirements of the truss 10 and structure that the truss 10 will be provided in for use. As a non-limiting illustrative aspect, the thickness of the web members 16 and bridge web 24 may be provided in a range between about 0.25 cm and about 3.2 cm (about 0.1 inch and about 1.25 inches). In other aspects of the embodiments, web member 16 and bridge web 24 thickness may be provided in a range between about 0.5 cm and about 2.54 cm (about 0.2 inch and about 1.0 inch). Moreover, web member 16 and bridge web 24 thickness may be provided in a range between about 0.75 cm and about 1.9 cm (0.3 inch and about 0.75 inch), and in a further aspect of the embodiments, thickness may be provided in a range between about 1 cm and about 1.5 cm (about 0.4 inch and about 0.6 inch). In another aspect, web member 16 and bridge web 24 thickness may be provided at about 1.3 cm (0.5 inch).

An additional aspect of the embodiments includes surface treatment configuration of truss 10. Truss 10 can be configured to enable any number of truss 10 components or all components of truss 10 to be surface treated. For example, and in no manner intending to limit the embodiments, surface treatment may include galvanization, cleaning, heat treatment, electroplating, electroless plating, polishing, chemical treating to create films by a chemical reaction, anodic oxidation (also known as anodizing), hot dipping, specialty finishes, vacuum plating, painting, powder coating, coating by other methods, and any surface treatment now known or hereinafter developed.

Additionally, any one of web member 16 and bridge web 24 can provide truss 10 with a capability to be provided with indicia thereon. Indicia, as embodied by the disclosure, can include but is not limited to, colorization (such as colors associated with a user of the facility where the truss is positioned), printed messages, such as logos, aesthetic design features, information for building design or structurally specific information (such as, but not limited to, safety information), or any other indicia.

Moreover, given the planar aspects of angled interconnecting web piece 163 of web member 16 and legs or angled interconnecting web pieces 244 of bridge web 24, an additional aspect of the embodiments facilitates mounting of banners, placards, and the like on angled interconnecting web piece 163 of web member 16 and legs or angled interconnecting web pieces 244 of bridge web 24.

A further aspect of the embodiments, includes providing at least one of angled interconnecting web piece 163 of web member 16 and legs or angled interconnecting web pieces 244 of bridge web 24 with cut outs. Cut outs may be provided in at least one of angled interconnecting web piece 163 of web member 16 and legs or angled interconnecting web pieces 244 of bridge web 24 while maintaining the structural and design requirements for use of truss 10.

Second lateral end 162 of web member 16 may also include a hanger tab. Hanger tab includes a length greater than space S and thus extends beyond lower angle assembly 14. In certain aspects of the embodiment, hanger tab extends a sufficient distance beyond lower angle assembly. Hanger apertures can be configured to support roof frames. Also, hanger apertures may be configured to receive items to be supported therefrom. Items can include but are not limited to banners, flags, lighting, safety information, notices, and other such items now known or hereinafter developed.

Bridge web 24 can include a lower web piece. As noted above, space S exists between outer surface of horizontal members 142, 146 and lower angle assembly 14. In certain aspects of the embodiment, hanger tab extends a sufficient distance beyond lower angle assembly 14 so hanger apertures are clear of lower angle assembly 14. As above, hanger apertures from lower web piece 243 are configured to receive items to be supported therefrom. Hanger apertures can be configured to support roof frames. Also, hanger apertures may be support items, that include but are not limited to, banners, flags, lighting, safety information, notices, and other such items now known or hereinafter developed.

As discussed above, the angle α dimension is merely illustrative of the possible orientations of angled interconnecting web piece 163 between first lateral end 161 and second opposed lateral end 162 of web member 16 as well as that of legs or angled interconnecting web pieces 244 between two upper web pieces 241, 242. In an aspect of the embodiments, one or more of web member 16 and or bridge web 24 can be fabricated with different angles other than about 45° that is illustrated in the Figures. Therefore, spacing of "open" areas between angled interconnecting web piece 163, legs or angled interconnecting web pieces 244, interconnecting members 18, end interconnecting members 20, and connecting members 21 of truss 10 can vary during fabrication, such as but not limited, for MEP coordination.

This variation of angle α dimension can be provided on one or more of web member 16 and or bridge web 24 can be advantageous if the building information model (BIM) calls for specific positioning of electrical or HVAC ducts, fire suppression systems, other structural beam positioning, and other structural specifics.

Varying of angle α dimension may be in coordination mechanical, electrical, and plumbing (MEP) specifications in the configuration of one or more truss 10. Typically, MEP work occurs after site, foundation, and building work has already occurred. MEP hardware may then be put in place; however, MEP work must design around the already in place building structure. This design around may slow down completion of the building as MEP work may have to be reconfigured. Moreover, this design around reconfiguration may increase overall cost of building ownership as materials for reconfiguration around conventional truss structures may be needed.

Variation of angle α dimension, as embodied by the disclosure, can be formed during fabrication of one or more of web member 16 and or bridge web 24. Varying angles in coordination with MEP designs may enable effective, efficient, and convenient structures of MEP designs. For example, and in no manner limiting of the embodiments, plumbing for fire suppression can run in straight paths. With variation of angle α dimension on one or more of web member 16 and or bridge web 24, as embodied by the disclosure, moving of fire suppression heads can be avoided. Providing truss 10 with consideration of MEP hardware and design needs, may avoid numerous joints, bends, and other hardware modifications, which add cost, and possible fault locations.

The varying of angle α dimension can be provided on one or more of web member 16 and or bridge web 24 that may enable efficient and effective runs of MEP hardware without necessitating reconfiguration of MEP hardware after a conventional truss is in place. Accordingly with varied spacing therebetween, web member 16 and/bridge web 24 can be customized for a customer's needs.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to bolt end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A truss system, comprising:

an upper angle assembly having a first upper angle bar and a second upper angle bar;

a lower angle assembly having a first lower angle bar and a second lower angle bar;

a plurality of interconnecting members; and a plurality of web members, each web member having:

an upper free end configured to attach to the upper angle assembly in an upper gap between the first upper angle bar and the second upper angle bar;

a lower free end configured to attach to the lower angle assembly in a lower gap between the first lower angle bar and the second lower angle bar; and an angled interconnecting web piece disposed between the upper free end and the lower free end; and wherein both the upper and lower free ends include:

an outward facing horizontal edge having associated first bolt holes for attachment to a respective one of the upper angle assembly and lower angle assembly; and an angled edge angled with respect to the outward facing horizontal edge and having associated second bolt holes for attachment to an end of an associated interconnecting member.

2. The truss system of claim 1, wherein both the upper and lower free ends further include:

an inward facing horizontal edge substantially parallel to the outward facing horizontal edge; and a second angled edge disposed between the angled edge and the inward facing horizontal edge.

3. The truss system of claim 2, wherein the angled edge and second angled edge are substantially perpendicular.

4. The truss system of claim 1, wherein each interconnecting member is configured to attach to the upper free end and the lower free end of adjacent web members.

5. The truss system of claim 1, wherein the second bolt holes are aligned with the angled edge.

6. The truss system of claim 1, further comprising a bridge web, comprising:

a left free end;

a right free end; and a central web piece connected to the left free end and right free end via a pair of angled interconnecting pieces;

wherein the left and right free ends each include:

a bridge outward facing horizontal edge having associated third bolt holes for attachment to one of the upper angle assembly or lower angle assembly; and a bridge angled edge, angled with respect to the bridge outward facing horizontal edge and having associated fourth bolt holes for attachment to a further angled interconnecting member.

7. The truss system of claim 6, wherein the fourth bolt holes are aligned with the bridge angled edge.

* * * * *